United States Patent [19]

Sonoda

[11] Patent Number: 4,811,718

[45] Date of Patent: Mar. 14, 1989

[54] FUEL SUPPLY SYSTEM FOR INTERNAL COMBUSTION ENGINE

[75] Inventor: Satoshi Sonoda, Tokyo, Japan

[73] Assignee: Kioritz Corporation, Tokyo, Japan

[21] Appl. No.: 198,694

[22] Filed: May 24, 1988

[30] Foreign Application Priority Data

Jun. 4, 1987 [JP] Japan ..... 62-138896

[51] Int. Cl.[4] ..... F02M 39/00

[52] U.S. Cl. ..... 123/517; 123/516; 123/179 L; 137/588; 261/DIG. 8; 261/36.1

[58] Field of Search ..... 123/519, 516, 514, 518, 123/519, 520, 521, 510, 179 L, 179 G; 261/DIG. 8, DIG. 19, 36 A; 137/588, 595

[56] References Cited

U.S. PATENT DOCUMENTS

| | | | |
|---|---|---|---|
| 1,662,614 | 3/1928 | Mandolini | 137/588 |
| 2,675,293 | 4/1954 | Zeige | 137/588 |
| 2,722,208 | 11/1955 | Conroy | 261/DIG. 8 |
| 2,965,086 | 12/1960 | Gregory | 123/517 |
| 3,118,492 | 1/1964 | Stone | 123/514 |
| 3,177,920 | 4/1965 | Phillips | 123/179 L |
| 3,233,652 | 2/1966 | Phillips | 261/DIG. 8 |
| 3,275,305 | 9/1966 | Nutten | 123/179 A |
| 3,695,590 | 10/1972 | Nishihara | 123/516 |
| 3,738,622 | 6/1973 | Tuckey | 123/516 |
| 3,948,589 | 4/1976 | Dubois | 261/DIG. 8 |
| 4,150,684 | 4/1979 | Kervin | 137/595 |
| 4,502,516 | 3/1985 | Shields | 137/588 |
| 4,651,889 | 3/1987 | Uranashi | 137/588 |
| 4,747,942 | 5/1988 | Strauss | 137/595 |

*Primary Examiner*—Carl Stuart Miller

*Attorney, Agent, or Firm*—Browdy & Neimark

[57] ABSTRACT

A fuel supply system for an internal combustion engine comprising: a suction pump provided in a fuel supply passage, a ventilation passage for allowing interior space of a fuel tank to be communicated with the atmosphere, a normally closed ventilation valve disposed in the ventilation passage, and a normally-closed release valve disposed in the fuel return passage and adapted for opening the fuel return passage at the time of start-up of the engine. The release valve and the ventilation valve being operatively connected to each other such that they are opened and closed simultaneously.

2 Claims, 1 Drawing Sheet

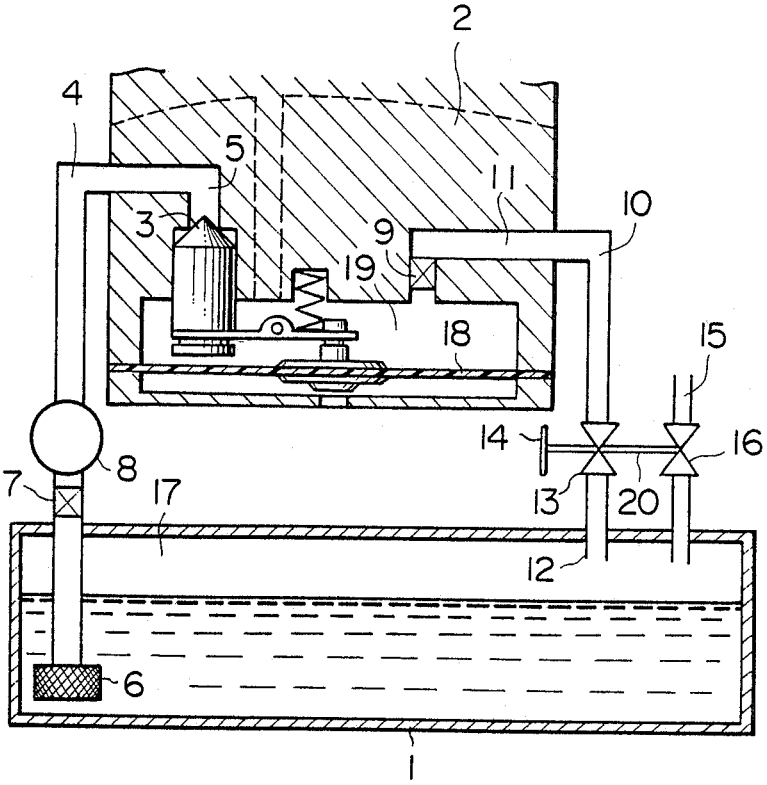
2
4
5
11
10
3
9
19
18
15
14
16
8
7
17
13
20
12
6
1

FUEL SUPPLY SYSTEM FOR INTERNAL COMBUSTION ENGINE

BACKGROUND OF THE INVENTION

The present invention relates to a fuel supply system for an internal combustion engine and more particularly, to a fuel supply system having a fuel passage for supplying a fuel from a fuel tank to a carburetor of an internal combustion engine, a suction pump which is operated at the time of start of the engine and adapted for sucking fuel into the carburetor through the fuel supply passage, a fuel return passage for allowing excessive fuel in the carburetor to be returned to the fuel tank, and a normally closed release valve provided in the fuel return passage and adapted to open the fuel return passage when the engine is started. Still more particularly, the present invention is concerned with a fuel supply system of the type mentioned above, suitable for use in a device incorporated in various types of working machines.

Fuel supply systems of the type stated above have been used in internal combustion engines used as the power sources of various types of working machine, for the purpose of supply fuel from fuel tanks to carburetors, especially diaphragm-type carburetors with release valves. In this type of known fuel supply system, the suction pump serving as the start-up pump is usually provided in the fuel return passage.

This known fuel supply system, however, suffers from a problem in that air tends to flow into the suction pump through the fuel return passage. In particular, when the air in the fuel tank is heated to develop a pressure higher than the atmospheric pressure as in the case of the use at high ambient air temperature, air flows into the suction pump through the fuel return passage, so that the fuel pump fails to suck the fuel satisfactorily.

SUMMARY OF THE INVENTION

Accordingly, an object of the present invention is to provide a fuel supply system which is improved in such a way as to overcome the above-described problem of the prior art.

More specifically, the present invention aims as its object at providing a fuel supply system in which a suction pump is provided in the fuel supply passage for supplying fuel to a carburetor so as to prevent air from flowing backward through the fuel return passage and being sucked by the suction pump, thus ensuring a high efficiency of operation of the suction pump, while simplifying the construction and facilitating the operation of the fuel supply system.

Namely, according to the present invention, there is provided a fuel supply system for an internal combustion engine having a fuel supply passage for supplying a fuel from a fuel tank to a carburetor of an internal combustion engine, a suction pump adapted to be operated at the time of start-up of the engine and adapted to suck the fuel into the carburetor through the fuel supply passage, a fuel return passage for allowing the excessive fuel in the carburetor to be returned to the fuel tank, and a normally closed release valve disposed in the fuel returning passage and adapted for opening the fuel returning passage when the engine is started up, said fuel supply system characterized in that said suction pump is disposed in the fuel supply passage and in that a normally closed communication valve is disposed in the communication passage and is operatively connected to a release valve so that the communication valve and the release valve are opened and closed simultaneously.

In the fuel supply system of the present invention, a suction pump serving as a start-up pump is provided in the fuel supply passage, and a communication passage is provided to allow the interior of the fuel tank to be communicated with the atmosphere, the communication passage having a normally-closed communication valve which is operatively connected to the release valve such that the communication valve and the release valve are opened and close simultaneously. With this arrangement, the suction pump is disposed apart from the fuel return passage and the pressure of the interior of the fuel tank is maintained at the same level as the atmospheric pressure when the engine is started, so that the back flow air through the fuel return passage into the suction pump is avoided to maintain the pumping performance of the suction pump. In addition, since the communication valve opens and closes in accordance with the operation of the release valve, it is possible to realize quick start-up of the engine and to facilitate the start-up of the engine, without causing any unfavorable effect on the normal operation of the engine.

The fuel supply system of the invention having the described features can operate efficiently even under hot atmosphere. In addition, the pressure rise in the fuel tank which may be caused by the initial boiling gas at the time of filling of the tank is restrained by suitably opening the communication valve.

The above and other objects, features and advantages of the present invention will become clear from the following description of the preferred embodiment when the same is read in conjunction with the accompanying drawings.

BRIEF DESCRIPTION OF THE DRAWING

The attached sole FIGURE shows an embodiment of a fuel supply system of the present invention for supplying a fuel to a carburetor.

DESCRIPTION OF THE PREFERRED EMBODIMENT

A preferred embodiment of the present invention will be described hereinunder with reference to the accompanying drawing.

The attached sole FIGURE is a diagrammatic illustration of an embodiment of the fuel supply system of the invention designed for supplying a fuel to an internal combustion engine. Referring to this Figure, an internal combustion engine (not shown) of a working machine has a fuel tank 1 attached to the frame of the machine and capable of storing fuel, and a carburetor through which air-fuel mixture is fed to the engine. The carburetor 2 has a fuel supply passage 4 constituted by, for example, a conduit. An automatic needle valve 3 adapted to be controlled by a diaphragm 18 is provided at the downstream end 5 of the fuel supply passage 4. The upstream end 6 of the fuel supply passage 4 opens into the fuel of the fuel tank 1 through a strainer. A check valve 7 such as a ball valve is disposed at an intermediate portion of the fuel supply passage 4 and a suction pump 8 serving as a start-up pump is disposed in the portion of the fuel supply passage 4 downstream from the check valve. The check valve 7 allows the fuel to flow from the fuel tank 1 to the suction pump 8 but prevents the same from flowing from the suction pump 8 to the fuel tank 1. The suction pump 8 is made of a hollow bulb made from a synthetic resin or a rubber. Prior to the start-up of the internal combustion engine, the operator compresses the bulb and then allows it to expand and this operation is repeated so that the fuel is sucked from the fuel tank 1 and fills a fuel chamber 19 of the carburetor 2 by forcibly opening the needle valve 3.

The carburetor 2 is communicated with an upstream end 11 of a fuel outlet 9 of a fuel return passage 10 constituted by, for example, a fuel conduit, while a downstream end 12 of the fuel return passage 10 is opened to the interior space 17 of the fuel tank 1. The fuel return passage 10 is provided at its intermediate portion with a release valve 13 which is provided with a release lever 14 which is adapted to be manually operated so as to activate a valve member adapted for opening and closing the flow passage therein. The release valve 13 is normally closed but the operator can operate the release valve 13 by manipulating the release lever 14 such that the release valve 13 is opened to allow excessive fuel to return to the fuel tank 1 from the fuel outlet 9 of the fuel chamber 19.

In addition, the fuel supply system of the present invention has a ventilation passage 15 having one end opened to the interior space 17 in the fuel tank 1 above the level of the fuel therein. The ventilation passage 15 is opened to the atmosphere. A ventilation valve 16 is normally closed and is disposed in the vicinity of the release valve 13. A valve manipulating lever 20 is operatively connected to the release lever 14 of the release valve 13 in such a manner that, when the release valve 13 operates so as to open the fuel return passage 10 at the time of start-up of the engine, the valve manipulating lever 20 also opens the ventilation valve 16 so as to provide a communication between the interior space 17 of the fuel tank 1 and the atmospheric air. The ventilation valve 16, however, is normally closed so as to interrupt the interior space 17 of the fuel tank 1 from the ambient air.

In operation, the operator manipulates the release lever 14 so as to simultaneously open the release valve 13 and the ventilation valve 16 so as to provide a communication between the fuel chamber 19 of the carburetor 2 and the interior space 17 of the fuel tank 1 so as to bring the interior space 17 of the fuel tank 1 into communication with the atmosphere through the ventilation passage 15, thus maintaining the pressure of the interior space 17 of the fuel tank 1 at the same level as the atmospheric pressure. In this state, the bulb consisting the suction pump 8 is compressed and allowed to expand, thus causing the fuel in the fuel tank 1 to be fed through the upstream end 5 of the fuel supply passage 4 via the needle valve 3, thus filling the fuel chamber 19 of the carburetor 2. In this state, the excessive fuel overflowing the fuel chamber 19 of the carburetory 2 is returned to the fuel tank 1 through the fuel return passage 10 via the fuel outlet 9. The carburetory 2 is now ready to operate. The release lever 14 is then manipulated so as to simultaneously open the release valve 13 and the ventilation valve 16. In this state, the fuel supply passage 4 is completely filled with the fuel so that the carburetor 2 is continuously supplied with the fuel from the fuel tank 1 through the fuel supply passage 4 at a rate corresponding to the rate of supply of the fuel from the carburetor 2 to the internal combustion engine.

What is claimed is:

1. A fuel supply system for an internal combustion engine having a fuel supply passage for supplying fuel from a fuel tank to a carburetor of the internal combustion engine, a suction pump adapted to be operated at the time of start-up of the engine and adapted to suck the fuel into the carburetor through the fuel supply passage, a fuel return passage for allowing excessive fuel in the carburetor to be returned to the fuel tank, and a normally closed release valve disposed in the fuel return passage and adapted for opening the fuel return passage when the engine is started up, said fuel supply system characterized in that said suction pump is disposed in the fuel supply passage and in that a normally closed ventilation valve is disposed in a ventilation passage and is operatively connected to the release valve so that the ventilation valve and the release valve are opened and closed simultaneously.

2. A fuel supply system according to claim 1, wherein said fuel return passage and said ventilation passage are arranged in a side-by-side fashion such that the ventilation valve is opened and closed by a lever for manipulating the valve member of said release valve.

* * * * *